United States Patent [19]

Ruscitti

[11] Patent Number: 4,826,031

[45] Date of Patent: May 2, 1989

[54] CONTAINER OF FLUID SUBSTANCES FOR USE WITH MANUALLY OPERABLE SMALL PUMPS FOR THE DELIVERY OF SUCH SUBSTANCES

[75] Inventor: Tommaso Ruscitti, Milian, Italy

[73] Assignee: S.A.R. S.p.A., Chieti, Italy

[21] Appl. No.: 183,392

[22] Filed: Apr. 13, 1988

Related U.S. Application Data

[63] Continuation of Ser. No. 36,184, Apr. 9, 1987, abandoned, which is a continuation of Ser. No. 535,722, Sep. 26, 1983, abandoned.

[30] Foreign Application Priority Data

Dec. 10, 1982 [IT] Italy ..... 23675/82[U]

[51] Int. Cl.[4] ..... B65D 6/00; B65D 25/02

[52] U.S. Cl. ..... 220/4 B; 222/321

[58] Field of Search ..... 220/4 R, 4 B, 4 C, 4 E; 222/321

[56] References Cited

U.S. PATENT DOCUMENTS

| | | | |
|---|---|---|---|
| 987,970 | 3/1911 | Earl | 222/321 |
| 1,290,435 | 1/1919 | Watrous | 222/321 |
| 1,810,135 | 6/1931 | Fitch | 222/321 |
| 3,211,346 | 10/1965 | Meshberg | 222/321 |
| 4,106,657 | 8/1978 | Dogliotti | 220/4 C |

FOREIGN PATENT DOCUMENTS

| | | | |
|---|---|---|---|
| 2522283 | 9/1983 | France | 222/321 |

*Primary Examiner*—George E. Lowrance

*Attorney, Agent, or Firm*—Oblon, Fisher, Spivak, McClelland & Maier

[57] ABSTRACT

A container for fluid substances for use with a manually operable small pump for dispensing such substances, comprising at least two distinct parts that can be mechanicaly and sealingly interconnected, a first part being provided with an inlet for securing a manually operable type of small pump thereon, and a second part being cup-shaped overall and having at the bottom thereof a hole of comparatively large size which can be closed by a plug, a second part of the container having integral therewith an elongate cylindrical tubular body, the lower end of which is open adjacent the bottom of said second part, and the other end of which is shaped to accomodate by sealing and simple friction the lower end of a small pump whichh is mounted to the inlet of the first part of the container when the latter is connected with the second part of said container.

2 Claims, 1 Drawing Sheet

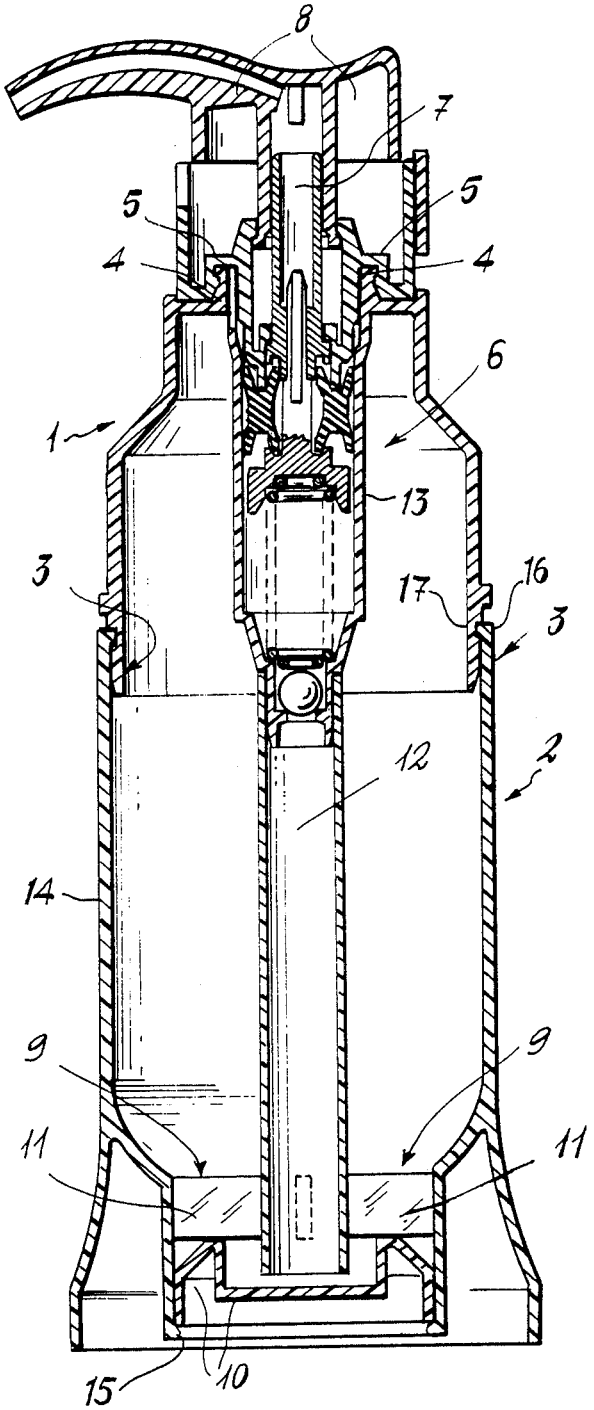
8
7
5
5
4
4
6
1
13
3
17
16
3
12
2
14
9
9
11
11
15
10

CONTAINER OF FLUID SUBSTANCES FOR USE WITH MANUALLY OPERABLE SMALL PUMPS FOR THE DELIVERY OF SUCH SUBSTANCES

This application is a continuation of application Ser. No. 036,184, filed on Apr. 9, 1987, now abandoned, which is a continuation of Ser. No. 535,722, filed on Sept. 26, 1983, now abandoned.

BACKGROUND OF THE INVENTION

1. Field of the Invention

This invention relates to a container for use with a manually operable small pump for pressure delivery of a liquid or soft substance contained in the container to which such a small pump is applied.

2. Discussion of the Background

As well known, there is an increasing wide use of manually operable small pumps enabling the dispensing of metered amounts of fluid substances contained within bottles on which said small pumps are mounted. Small pumps of this type are described, for example, in U.S. Pat. Nos. 3,211,346; 3,187,960; 3,500,761; and 4,113,145 and in the British patent application No. 2,091,818 A.

At present, such small pumps are mounted (screwed, seamed or otherwise secured) to the inlet of a container in the shape of a phial or bottle after the substance to be dispensed has been inserted therein.

This has a number of drawbacks, mainly resulting from the small size of the container inlet. It is generally difficult to fill the container with soft substances, such as creams, toothpaste, etc., and the small pump can be mounted on the container only after the latter has been filled with the substance to be dispensed. Accordingly the container must be kept steady during such an operation, with the inlet facing upward. In addition, it is quite difficult and complicated to insert a drawing tube, which extends below the small pump and may be somewhat curved, into the container inlet.

SUMMARY OF THE INVENTION

It is an object of the invention to provide a container of the aforesaid type, that is, for use with manually operable small pumps to deliver substances under fluid pressure, which enables the very easy and rapid filling of the container with the substance to be delivered, considerably simplifies the mating of the container with the small pump, and which has a simple structure and is inexpensive to produce.

Such a container is characterized by being made of two distinct major parts that are mechanically and sealingly interconnected, a first part being provided with an inlet for securing thereon a manually operable type of small pump, and a second part being cup-shaped overall and which, at the bottom thereof, has a hole of comparatively large size, sealable by a plug, said second part of the container having integral therewith an elongate cylindrical tubular body. The lower end of the tube is open so as to communicate with the interior of the second part, and the other end of the tube is so shaped as to accommodate, by substantial sealing and simple friction, the lower end of the small pump, which enters the tubular body at the time that the first part of the container is connected with the second part of said container.

BRIEF DESCRIPTION OF THE DRAWING

In order that the structure and features of a container according to the present invention be more clearly understood, a preferred embodiment thereof will now be described with reference to the accompanying drawing, in which the single figure is an axial section showing a container to which a manually operable small pump is applied.

DESCRIPTION OF THE PREFERRED EMBODIMENT

The container shown in the drawing comprises a first part 1 and a second part 2, the latter having a portion 14 that is substantially cup-shaped. The two parts 1 and 2 are interconnected to form a tight seal therebetween by a snapping joint 3 which includes an annular rib 16 and a corresponding mating groove 17.

It clearly appears that the connection between the two container parts 1 and 2 also could be provided in a different manner, but equivalent to that herein shown, for example by screw threads, gluing or welding.

The top part 1 of the container has an inlet 4, to which the ring nut 5 of the manually operable small pump 6 is secured. The small pump shown in the drawing is of the type as disclosed and claimed in the British patent application No. 2,091,818 A. The small pump stem 7 has applied thereto a dispensing cap 8 of any known type. In the bottom of the cup-shaped portion 14 of the second part 2, an opening 9 is provided of comparatively large size (as shown in the drawing), which can be sealingly closed by a plug 10, the latter being affixed to said second part 2 by snap action of annular rib 15 or by friction, or by screwing or the like. Adjacent the bottom of the second part 2, there are provided tabs 11 integral with a cylindrical tubular body 12. The lower end of this tubular body 12 is spaced from the adjacent plug 10. However, the free lower end of said tubular body 12 could obviously be closed, in which case one or more slots would be provided in said tubular body adjacent its lower end.

Of course, the second part 2, tabs 11 and cylindrical tubular body 12 are advantageously made in a single piece by molding a suitable plastic material. Similarly, the first part 1 and said plug 10 are made of distinct, separate parts of molded plastic material.

The assembly of the container and small pump will now be described. Assume that the three distinct elements 1, 2 (along with the tabs 11 and tubular body 12) and 10 have been already provided.

The small pump 6 is secured (in the case shown, by snapping action) on the first part 1, then the first and second parts 1 and 2 are interconnected (in the case shown, by snapping action). Of course, the first and second parts 1 and 2 could first be interconnected and then the small pump 6 could be applied to the inlet 4 of the container thus assembled.

In any case, the important feature is that, when the main body 13 of the small pump approaches the tubular body 12, the lower end of the main body 13 of the small pump is automatically and sealingly inserted within the free upper end of said tubular body 12. The upper end of tubular body 12 may be flared to facilitate this insertion.

Summarizing, the container with the small pump can be easily and readily assembled merely by mating the small pump 6 and the first and second container parts 1 and 2. Thereafter, the assembled container and pump are inverted, so that the opening 9 is on top, thereby making possible an easy and rapid operation to fill up the container with any fluid or soft substance, such as a cream or a toothpaste. Then the plug 10 is applied and the container with the small pump is ready to use for substance dispensing.

It may be pointed out that, during introduction of the fluid substance through the opening 9, the substance may also fill the tubular body 12, thus facilitating or even making unnecessary the priming of the small pump, an operation which is necessary with the systems presently known to start the dispensing of a substance with a small pump.

Obviously, numerous modifications and variations of the present invention are possible in light of the above teachings. It is therefore to be understood that within the scope of the appended claims, the invention may be practiced otherwise than as specifically described herein.

I claim:

1. A container for use with a manually operable pump, comprising:

a first body having an external wall and an internal tubular main body extension for housing said manually operable pump;

a second body connected to said first body and having a cup-shaped external wall and an internal elongated tubular body connected to said manually operable pump wherein a bottom portion of said cup-shaped external wall is provided with an opening and a plurality of tabs positioned in said opening such that said tubular body extends into said opening and is integral with the external wall through said plurality of tabs so as to define a plurality of passages in communication with said opening; and a plug member for sealingly closing said opening.

2. A container as set forth in claim 1, further comprising snap fitting means interconnecting said first body with said second body.

* * * * *

UNITED STATES PATENT AND TRADEMARK OFFICE

CERTIFICATE OF CORRECTION

PATENT NO. : 4,826,031

DATED : May 2, 1989

INVENTOR(S) : Tommaso Ruscitti

It is certified that error appears in the above-identified patent and that said Letters Patent is hereby corrected as shown below:

On the Title Page, Item (75), the inventor's city of residence is incorrect, it should read as follows:

--Milan, Italy--.

Signed and Sealed this

Thirteenth Day of March, 1990

*Attest:*

JEFFREY M. SAMUELS

*Attesting Officer*

*Acting Commissioner of Patents and Trademarks*